US005296338A

United States Patent [19]

Chester

[11] Patent Number: 5,296,338

[45] Date of Patent: Mar. 22, 1994

[54] ANTISTATIC STABILIZER AND FINAL WASH ADDITIVE FOR PHOTO DEVELOPING

[76] Inventor: John A. Chester, 604 John Ross Ct., Woodstock, Ga. 30188

[21] Appl. No.: 82,231

[22] Filed: Jun. 24, 1993

[51] Int. Cl.[5] ..... G03C 11/06

[52] U.S. Cl. ..... 430/372; 430/428; 430/429; 430/463

[58] Field of Search ..... 430/372, 428, 429, 463

[56] References Cited

U.S. PATENT DOCUMENTS 4,804,497 2/1989 Urfer et al. ..... 252/8.8

5,019,376 5/1991 Uick ..... 252/547

5,225,320 6/1993 Kuse et al. ..... 430/372

*Primary Examiner*—Hoa Van Le

*Attorney, Agent, or Firm*—Baker & Daniels

[57] ABSTRACT

The present invention relates to photographic processing, and specifically discloses the use of ethyl bis (polyethoxy ethanol) alkyl ammonium ethyl sulfate as the effective ingredient in an anti-static additive for photographic processing. The effective ingredient is combined with isopropanol and water in the ratio of 8 oz./2 oz./118 oz. (per gallon) to provide the desired anti-static coating to the photographic negatives.

12 Claims, No Drawings

ANTISTATIC STABILIZER AND FINAL WASH ADDITIVE FOR PHOTO DEVELOPING

BACKGROUND OF THE INVENTION

1. Field of the Invention

The present invention relates to the development of photographs. More particularly, the field of the invention is that of anti-static stabilizer additives used during photo processing and finishing.

2. Description of the Related Art

During the processing of photographic negatives, most particularly during the drying process, the photographic negatives surfaces require a "static charge" sufficient to attract and hold dust, lint, and other airborne particles. Consequently, the negatives must be cleaned before printing, typically by a mechanism which wipes the negative. Unless the negatives are cleaned, the resulting photographs would be of poor quality, i.e., they would appear spotted or otherwise marked.

However, the use of a mechanical wiper or other cleaning mechanism may damage the negatives and also produce photographs of poor quality.

What is needed is an additive for the final wash which minimizes the static charge on the photographic negatives.

SUMMARY OF THE INVENTION

The present invention is an anti-static additive which virtually eliminates the electrostatic charge ("static electricity") which would otherwise build up on the photographic negatives during the drying process. More specifically, the cationic nature and composition of this complex formula is such as to attach itself to the film being processed in the form of a one (1) molecular thick shield of cationic ions, thereby preventing or neutralizing the electrostatic conditions causing photographic negatives to attract and adhere dust, lint, etc. In addition to the particular benefits to the photographic negative, the present invention also makes other surfaces with which it comes into contact, photo/mechanical processors, tanks, and related equipment, cleaner and slicker, thereby reducing water spotting on negatives and improving print quality even further.

DESCRIPTION OF THE PREFERRED EMBODIMENT(S)

The preferred embodiments disclosed below are not intended to be exhaustive or limit the invention to the precise forms disclosed in the following detailed description. Rather, the embodiments are chosen and described so that others skilled in the art may utilize their teachings.

The present invention relates to an additive used in the final wash in the development of photographic negatives. The additive's effective ingredient is ethyl bis (polyethoxy ethanol) alkyl ammonium ethyl sulfate, commonly made available as VARIQUAT 66, from Sherex-Witco of Dublin, Ohio (VARIQUAT is a registered trademark of Sherex-Witco). The effective ingredient is combined with isopropanol and water in a proportion of less than 35% of the effective ingredient, less than 5% isopropanol, and the remainder water. Preferably, 8 ounces of the effective ingredient and 2 ounces of isopropanol are combined with 118 ounces of water to produce one gallon of BANSTATIC PLUS®. This composition is sold under the registered trademark BANSTATIC PLUS of New Ventures, Inc. located in Woodstock, Ga.

BANSTATIC PLUS® is an anti-static stabilizer and final wash additive that when mixed with process C-41 or E-6 stabilizer solutions, virtually eliminates static charge which builds up on film during the drying procedure. The Process C-41 is widely used to develop color negative film, and relates to a six step process: developer, bleach, fixer, wash, stabilizer, and dry. The Process E-6 is widely used to develop color slide film, and relates to a ten step process: first developer, first wash, reversal bath (to chemically reverse the image), color developer, pre-bleach, bleach, fixer, second wash, third (final) wash, and dry. BANSTATIC PLUS® is used in the stabilizer step in the C-41 process, and in the third and final wash step in the E-6 process.

Treatment of film with BANSTATIC PLUS® places a microscopically thin shield on the film that repels static, dust, dirt and lint to significantly reduce remakes caused by these conditions.

Add BANSTATIC PLUS® to stabilizer replenisher or wash in accordance with the following table, and mix thoroughly for 5–10 minutes or until uniform.

| To this Volume of Stabilizer or Final Wash | Add this Volume of BANSTATIC PLUS® |
|---|---|
| 1 Liter | 5 ml/.17 ozs. |
| 10 Liters | 50 ml/1.7 ozs. |
| 20 Liters | 100 ml/3.4 ozs. |
| 1 Gallon | 19 ml/.64 ozs. |
| 2.5 Gallons | 47 ml/1.6 ozs. |
| 5 Gallons | 95 ml/3.2 ozs. |
| 10 Gallons | 190 ml/6.4 ozs. |
| 12.5 Gallons | 237 ml/8 ozs. |
| 25 Gallons | 473 ml/16 ozs. |
| 75 Gallons | 1420 ml/48 ozs. |
| 100 Gallons | 1893 ml/64 ozs. |
| 150 Gallons | 2840 m/96 ozs. |

1 gal. = 3.785 L.
1 oz. = 29.57 ml.

The most effective way to begin using BANSTATIC PLUS® is to treat all the film process stabilizer chemistry used in the lab at one time. The entire system (replenisher tanks, replenishment lines, and processor tanks) must be cleaned thoroughly to maximize the special qualities of BANSTATIC PLUS®.

SYSTEM CLEANING AND PREPARATION

1. Pump over current volume of stabilizer replenisher held in the storage tank to a mix tank. Do not discard. This stabilizer replenisher will be used to make the new improved solution Clean and rinse the replenisher storage tank thoroughly with warm water to eliminate any sediment or residue buildup.

2. Clean and rinse chemical supply lines to film processors. This can be done by running warm water through these lines for 5–10 minutes or until clean. Let these lines then drain completely of rinsed water.

3. Dump the stabilizer tank(s) in each film processor and clean thoroughly. This is where the most important work must be done! Use warm water and scrub tank walls to eliminate all residue in each tank. If algae or biological growth is suspected in the stabilizer system see ALGAE-BIOLOGICAL GROWTH below.

4. Remove stabilizer chemical filters and clean system by filling tanks with warm water and running pumps (without filters) for 5–10 minutes or until clean.

5. Rinse tanks again with warm water, let drain and close drain plug.

Continued use of BANSTATIC PLUS® will clean the entire system over a period of time. That is why it is strongly recommended that the entire system be cleaned (storage tanks, replenishment lines and processor tanks) before adding BANSTATIC PLUS® to the stabilizer or final wash.

REFILL AND SYSTEM START UP

1. Using the stabilizer replenisher pumped over to the mix tank for temporary holding while cleaning the storage tank, the proper amount of BANSTATIC PLUS® is added to make the new enhanced anti-static stabilizer replenisher (See table for proper mix volume).

2. Refill stabilizer replenisher storage tank.

3. Refill processor stabilizer tanks with proper volume of stabilizer replenisher and water to make a working tank solution (see chemical manufacturer instructions for making a working tank solution of stabilizer).

4. Install new chemical filters in film processor and let pumps run for 15 minutes before processing film.

GRADUAL INTRODUCTION OF BANSTATIC PLUS®

The preferred way to begin using BANSTATIC PLUS® is to introduce the special anti-static qualities slowly to the film process over a period of time. This is done by simply adding BANSTATIC PLUS® to each new stabilizer replenisher mix. Once the working tank solution has turned over several times, BANSTATIC PLUS® will attain it's full strength. This procedure is not recommended unless the system is already very clean.

1. Dump the stabilizer tank in each film processor and clean thoroughly.

2. Add BANSTATIC PLUS® to the present stabilizer replenisher by pumping it over to a mix tank and adding the proper amount of BANSTATIC PLUS® for that volume. Mix for 5–10 minutes or until uniform and refill stabilizer replenisher tank. Add 8 ounces (one bottle) of BANSTATIC PLUS® to every 12.5 gallons of stabilizer replenisher and mix thoroughly for 5–10 minutes or until uniform. Add 0.64 ozs. per gallon or 5 ml per liter of BANSTATIC PLUS® to stabilizer replenisher (See table for proper mix volume).

3. Then add stabilizer replenisher with BANSTATIC PLUS® to finish the working tank solution in the processor.

Never add BANSTATIC PLUS® directly to any processor or tank without proper mixing first.

ALGAE-BIOLOGICAL GROWTH

If algae (biological growth) is present or suspected in the stabilizer system, it is advisable to eliminate this growth before refilling the system. A household bleach, like Clorox, may be used to eliminate biological growth. Add 1 gallon of household bleach to every 100 gallons of water, or 10 ml of household bleach to every liter of water in the processor or tank and bring volume up to tank overflow with water. Let the water/bleach solution sit in the tank for 1–2 hours.

Household bleach (Chlorine or Bromine) must not be mixed with Photo Bleach, Bleach-Fix, Fixer or any other chemical or cleaner. Mixing household bleach (Chlorine or Bromine) with any other chemical can result in dangerous vapors that can be hazardous. It is imperative that system operators be advised of this warning before attempting to use Chlorine or Bromine cleaning agents.

To reduce dust, lint, dirt and water spotting, circulation and filtration of the solution in each film processor stabilizer tank is recommended. Filters should be changed weekly or more often, if needed. This will reduce the need to "dump" the stabilizer tank so often.

Photo negatives processed with BANSTATIC PLUS® may be retouched by appropriate chemical agents. BANSTATIC PLUS®changes the electrostatic charge on the negative by applying a microscopically thin shield of Cationic ions, and presents no obstacle to penetration by an aqueous agent (retouching colors), nor does BANSTATIC PLUS® affect the retouching colors' characteristics or behavior.

While this invention has been described as having a preferred design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. In a wash for the photographic development of transparency films, an anti-static additive comprising:
- water;
- isopropanol; and
- ethyl bis (polyethoxy ethanol) alkyl ammonium ethyl sulfate.

2. The additive of claim 1, wherein said water is present in an amount of at least 60 percent by volume, said sulfate is present in an amount of less than 35 percent by volume, and said isopropanol is present in an amount of less than 5 percent by volume.

3. The additive of claim 2, wherein said water is present in an amount of about 92.2 percent by volume, said sulfate is present in an amount of about 6.3 percent by volume, and said isopropanol is present in an amount of about 1.5 percent by volume.

4. In a stabilizer for the photographic development of negative films, an anti-static additive comprising:
- water;
- isopropanol; and
- ethyl bis (polyethoxy ethanol) alkyl ammonium ethyl sulfate.

5. The additive of claim 4, wherein said water is present in an amount of at least 60 percent by volume, said sulfate is present in an amount of less than 35 percent by volume, and said isopropanol is present in an amount of less than 5 percent by volume.

6. The additive of claim 5, wherein said water is present in an amount of about 92.2 percent by volume, said sulfate is present in an amount of about 6.3 percent by volume, and said isopropanol is present in an amount of about 1.5 percent by volume.

7. A method of developing color negative film comprising the steps of:
- exposing a negative film to a developer;
- immersing the film in a bleach solution;
- immersing the film in a fixer solution;
- immersing the film in a wash solution; and
- immersing the film in a stabilizer comprising an anti-static additive wherein the additive comprises water, isopropanol and ethyl bis (polyethoxy ethanol) alkyl ammonium ethyl sulfate.

8. The method of claim 7, wherein said step of immersing the film in a stabilizer includes using a stabilizer wherein said water is present in an amount of at least 60 percent by volume, said sulfate is present in an amount of less than 35 percent by volume, and said isopropanol is present in an amount of less than 5 percent by volume.

9. The method of claim 8, wherein said step of immersing the film in a stabilizer includes using a stabilizer wherein said water is present in an amount of about 92.2 percent by volume, said sulfate is present in an amount of about 6.3 percent by volume, and said isopropanol is present in an amount of about 1.5 percent by volume.

10. A method of developing transparency film comprising the steps of:

exposing the film to a first developer;

immersing the film in a first wash;

immersing the film in a reversal bath for chemically reversing the image;

exposing the film to a second developer;

immersing the film in both a pre-bleach solution and a bleach solution;

immersing the film in a fixer solution;

immersing the film in a second wash solution; and immersing the film in a third wash solution comprising an anti-static additive, said additive comprising water, isopropanol and ethyl bis (polyethoxy ethanol) alkyl ammonium ethyl sulfate.

11. The additive of claim 10, wherein the step of immersing the film in a third wash solution includes using an anti-static additive wherein said water is present in an amount of at least 60 percent by volume, said sulfate is present in an amount of less than 35 percent by volume, and said isopropanol is present in an amount of less than 5 percent by volume.

12. The additive of claim 11, wherein the step of immersing the film in a third wash solution includes using an anti-static additive wherein said water is present in an amount of about 92.2 percent by volume, said sulfate is present in an amount of about 6.3 percent by volume, and said isopropanol is present in an amount of about 1.5 percent by volume.

* * * * *